United States Patent [19]

Hafner et al.

[11] Patent Number: 5,012,787

[45] Date of Patent: May 7, 1991

[54] FUEL INJECTION SYSTEM

[75] Inventors: Udo Hafner, Lorch; Harro Herth, Vaihingen/Enz; Wolfgang Kienzle, Schwieberdingen; Heinrich Knapp, Leonberg; Rudolf Krauss, Stuttgart; Manfred Lembke, Gerlingen; Werner Paschke, Schwieberdingen; Rudolf Sauer, Benningen, all of Fed. Rep. of Germany

[73] Assignee: Robert Bosch GmbH, Stuttgart, Fed. Rep. of Germany

[21] Appl. No.: 129,904

[22] Filed: Dec. 7, 1987

Related U.S. Application Data

[63] Continuation of Ser. No. 397,970, Jul. 14, 1982, abandoned.

[30] Foreign Application Priority Data

Oct. 16, 1981 [DE] Fed. Rep. of Germany ..... 3141154

[51] Int. Cl.[5] ..... F02M 37/04

[52] U.S. Cl. ..... 123/470; 123/472; 123/468; 123/516

[58] Field of Search ..... 123/470, 471, 472, 516, 123/514, 461, 462, 469, 468

[56] References Cited

U.S. PATENT DOCUMENTS

| | | | |
|---|---|---|---|
| 3,125,078 | 3/1964 | Reiners | 123/468 |
| 4,186,708 | 2/1980 | Bowler | 123/472 |
| 4,347,823 | 9/1982 | Kessler | 123/472 |

*Primary Examiner*—Carl Stuart Miller

*Attorney, Agent, or Firm*—Edwin E. Greigg

[57] ABSTRACT

A fuel injection system for internal combustion engines is proposed which serves the purpose of fuel injection into the air intake tube of the engine. The fuel injection system includes a fuel injection valve, which is supported upstream of a throttle valve in a holder body disposed coaxially in the air intake tube. A fuel supply line leads to the fuel injection valve, extending in a downwardly directed manner toward the fuel injection valve and away from a deaeration chamber. A fuel return line leads away from the fuel injection valve, extending in an upwardly inclined direction to discharge into the regulating chamber, disposed at a higher level, of a pressure regulating valve. A fuel feed line originating at a fuel supply pump terminates in an upwardly directed manner into the dearation chamber, which communicates via a dearation nozzle with the regulating chamber, so that vapor bubbles can escape upstream of the injection valve into the return side of the injection valve.

11 Claims, 1 Drawing Sheet

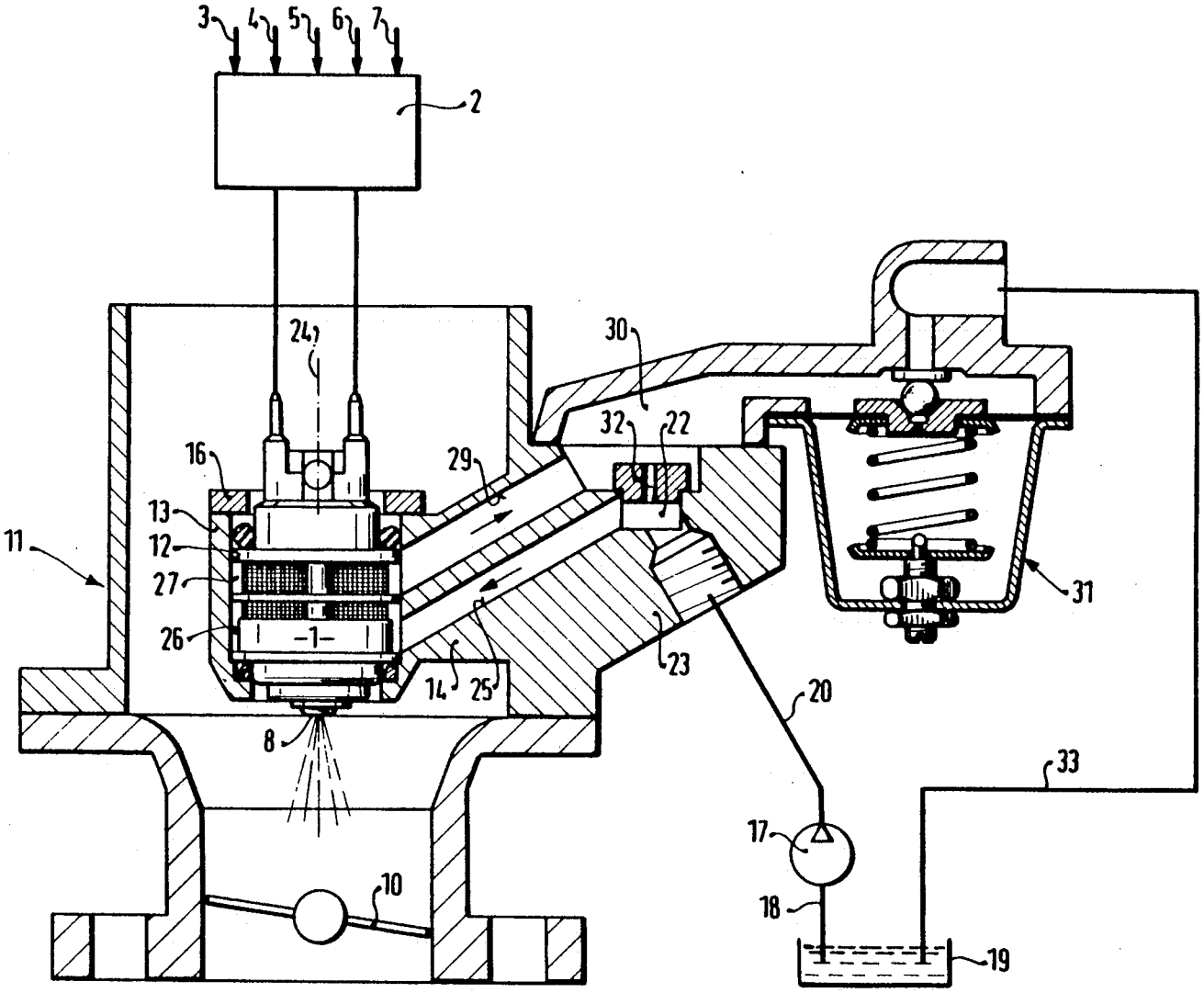
2
3
4
5
6
7
24
16
13
12
27
26
11
29
25
14
8
10
30
32
22
23
20
17
18
19
33
31

FUEL INJECTION SYSTEM

This is a continuation of copending application Ser. No. 397,970 filed July 14, 1982, now abandoned.

BACKGROUND OF THE INVENTION

The invention is directed to a fuel injection system having at least one injection valve disposed in an air intake tube subject to flow therethrough. A fuel injection system is already known in which the danger exists that vapor bubbles carried along with the fuel via the fuel supply line will reach the fuel injection valve, there causing malfunctioning of the valve and attendant difficulties upon starting the internal combustion engine.

OBJECT AND SUMMARY OF THE INVENTION

It is a principal object of the invention to provide a fuel injection system which has the advantage over the prior art that the movement of vapor bubbles contained in the fuel supplied to the fuel injection valve via the fuel supply line is hindered, and any vapor bubbles which may possibly form in the fuel injection valve are capable of escaping rapidly via the fuel return line, so that there is nothing but liquid fuel at the injection location.

Another object of the invention which is particularly advantageous is to have the fuel supply line separated from the fuel feed line by a deaeration chamber, which communicates via a deaeration nozzle with the fuel return line. As a result, any possible vapor bubbles which may have formed in the fuel can escape into the fuel outflow line through the deaeration nozzle upstream from the fuel injection valve.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing is a simplified illustration of the exemplary embodiment of the invention, which is described in detail below.

DESCRIPTION OF THE PREFERRED EMBODIMENT

The fuel injection system shown in the drawing has a fuel injection valve 1, which is electromagnetically actuatable in a known manner by means of an electronic control unit 2 in accordance with operating characteristics of the internal combustion engine, such as rpm 3, aspirated air quantity 4, throttle valve position 5, temperature 6, exhaust gas composition 7 and others. This fuel injection valve 1 serves to inject fuel via an outlet 8, in particular at low pressure, into the air intake tube 11 of mixture-compressing internal combustion engines having externally supplied ignition. The injection of fuel by the fuel injection valve may be effected simultaneously for all the cylinders of the engine into the air intake tube 11, either upstream or downstream of a throttle valve 10. In the exemplary embodiment shown in the drawing, the fuel injection valve 1 is supported upstream of the throttle valve 10 in a guide opening 12 of a holder body 13, which is disposed in the interior of the air intake tube 11 coaxially with this tube 11 and is connected via at least one holder strut 14 with the air intake tube 11, so that the holder body 13 is surrounded at least in part by a flow of the aspirated air. A claw or a cap 16 fixes the fuel injection valve 1 in its axial position in the holder body 13.

For supplying fuel to the fuel injection valve 1, a fuel supply pump 17, which may be driven by an electric motor, pumps fuel out of a fuel container 19 via an intake line 18 into a fuel feed line 20, which discharges into a deaeration chamber 22. The deaeration chamber is embodied by way of example in a thickened portion 23 of the air intake tube 11. The fuel feed line 20 advantageously discharges into the deaeration chamber 22 such that it is directed upward and inclined toward the deaeration chamber 22; however, it is also possible for the fuel feed line 20 to extend horizontally toward the deaeration chamber 22 into which it discharges. A fuel supply line 25 which is inclined relative to the longitudinal axis 24 of the fuel injection valve 1 and extends downward toward the fuel injection valve leads from the deaeration chamber 22 to a circumferential groove 26 between a portion of the outer circumference of the fuel injection valve 1 and the guide opening 12 in the holder body 13. The outlet of the fuel supply line 25 at the circumferential groove 26 is thus located at a lower level than is its initial portion at the deaeration chamber 22.

From the circumferential groove 26, the fuel passes through openings (not shown) in the wall of the fuel injection valve into the interior of the fuel injection valve and is ejected in part via the outlet 8, while another part of the fuel passes through the interior of the fuel injection valve and passes to the outside, via openings (not shown) in the wall of the fuel injection valve, into a circumferential groove 27, which is embodied between the circumference of the fuel injection valve 1 and the guide bore 12 and is separate from the circumferential groove 26. A fuel return line 29 leads upward from the circumferential groove 27, being inclined with respect to the longitudinal axis 24 of the fuel injection valve 1; this fuel return line discharges at its highest point into a regulating chamber 30 of a pressure regulating valve 31. The fuel return line 29 may extend parallel to the fuel supply line 25 and the two lines 25 and 29 may both be provided in the holder strut 14. As a result of the upwardly inclined course of the fuel return line 29, a rapid removal of vapor bubbles which may have formed in the fuel injection valve is assured. The deaeration chamber 22 communicates via a deaeration nozzle 32 with a point of the fuel return line 29 which is located at as high a level as possible, or with the regulating chamber 30. As a result, vapor bubbles are already removed and carried away from the supplied fuel at a safe distance from the fuel injection valve. The cross section of the deaeration nozzle 32 is selected by way of example such that approximately 2% of the quantity of fuel flowing back via the pressure regulating valve 31 into a return flow line 33 and to the fuel container 19 flows via the deaeration nozzle 32.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for a mixture-compressing internal combustion engine having externally supplied ignition which comprises an air intake tube and at least one fuel injection valve, said fuel injection valve being disposed in a holder body provided within said air intake tube and arranged to experience air flow circumferentially around said holder body and further arranged to communicate with a fuel supply line and a fuel return line, by means of which fuel is injectable into the air intake tube, said fuel supply line and said fuel return line are inclined relative to a longitudinal axis of said fuel injection valve, each of said lines extending toward the fuel injection valve in a downwardly directed manner, said fuel injection valve having first and second axially spaced circumferential grooves between an outer circumference of said fuel injection valve and an inner circumference of said holder body, each of said first and second grooves communicating respectively with an interior of said fuel injection valve, said first groove communicating with said fuel supply line and said second groove communicating with said fuel return line, said second groove that communicates with said fuel return line being above said first groove that communicates with said fuel supply line, a deaeration chamber connected to said fuel supply line remote from the fuel injection valve, said deaeration chamber is arranged to communicate via a deaeration nozzle with the fuel return line, a fuel feed line that extends from a fuel supply pump and discharges into the deaeration chamber, and said fuel feed line discharges into the deaeration chamber upwardly at an angle of inclination toward the deaeration chamber.

2. A fuel injection system for a mixture-compressing internal combustion engine having externally supplied ignition which comprises an air intake tube and at least one fuel injection valve, said fuel injection valve being disposed in a holder body provided within said air intake tube and arranged to experience air flow circumferentially around said holder body and further arranged to communicate with a fuel supply line and a fuel return line, by means of which fuel is injectable into the air intake tube, said fuel supply line and said fuel return line are inclined relative to a longitudinal axis of said fuel injection valve, each of said lines extending toward the fuel injection valve in a downwardly directed manner, said fuel injection valve having first and second axially spaced circumferential grooves between an outer circumference of said fuel injection valve and an inner circumference of said holder body, each of said first and second grooves, communicating respectively with an interior of said fuel injection valve, said first groove communicating with said fuel supply line and said second groove communicating with said fuel return line, said second groove that communicates with said fuel return line being above said first groove that communicates with said fuel supply line, a pressure regulating valve, said pressure regulating valve includes a valve seat and a valve closing element disposed at the highest point in said fuel return line, and a return flow line (33) connected to said pressure regulating valve at a point higher than said valve closing element.

3. A fuel injection system for a mixture-compressing internal combustion engine having externally supplied ignition which comprises an air intake tube and at least one fuel injection valve, said fuel injection valve being disposed in a holder body provided within said air intake tube and arranged to experience air flow circumferentially around said holder body and further arranged to communicate with a fuel supply line and a fuel return line, by means of which fuel is injectable into the air intake tube, said fuel supply line and said fuel return line are inclined relative to a longitudinal axis of said fuel injection valve, each of said lines extending toward the fuel injection valve in a downwardly directed manner, said fuel injection valve having first and second axially spaced circumferential grooves between an outer circumference of said fuel injection valve and an inner circumference of said holder body, each of said first and second grooves communicating respectively with an interior of said fuel injection valve, said first groove communicating with said fuel supply line and said second groove communicating with said fuel return line, said second groove that communicates with said fuel return line being above said first groove that communicates with said fuel supply line, a deaeration chamber connected to said fuel supply line remote from the fuel injection valve, said deaeration chamber is arranged to communicate via a deaeration nozzle with the fuel return line, a pressure regulating valve, said pressure regulating valve includes a valve seat and a valve closing element disposed at the highest point in said fuel return line, and a return flow line (33) connected to said pressure regulating valve at a point higher than said valve closing element.

4. A fuel injection system for a mixture-compressing internal combustion engine having externally supplied ignition which comprises an air intake tube and at least one fuel injection valve, said fuel injection valve being disposed in a holder body provided within said air intake tube and arranged to experience air flow circumferentially around said holder body and further arranged to communicate with a fuel supply line and a fuel return line, by means of which fuel is injectable into the air intake tube, said fuel supply line and said fuel return line are inclined relative to a longitudinal axis of said fuel injection valve, each of said lines extending toward the fuel injection valve in a downwardly directed manner, said fuel injection valve having first and second axially spaced circumferential grooves between an outer circumference of said fuel injection valve and an inner circumference of said holder body, each of said first and second grooves communicating respectively with an interior of said fuel injection valve, said first groove communicating with said fuel supply line and said second groove communicating with said fuel return line, said second groove that communicates with said fuel return line being above said first groove that communicates with said fuel supply line, a deaeration chamber connected to said fuel supply line remote from the fuel injection valve, said deaeration chamber is arranged to communicate via a deaeration nozzle with the fuel return line, a fuel feed line that extends from a fuel supply pump and discharges into the deaeration chamber, a pressure regulating valve, said pressure regulating valve includes a valve seat and a valve closing element disposed at the highest point in said fuel return line, and a return flow line (33) connected to said pressure regulating valve at a point higher than said valve closing element.

5. A fuel injection system for a mixture-compressing internal combustion engine having externally supplied ignition which comprises an air intake tube portion which is positionable above a throttle valve (10) in an air-fuel mixture tube which feeds an air-fuel mixture to the manifold of said engine, said air intake tube portion including an air intake tube (11), a holder body (13) coaxial with said air intake tube arranged to secure a fuel injection valve therein and to experience air flow circumferentially around said holder body, a holder strut (14) and a holder strut thickened portion (23), said holder strut thickened portion including a fuel supply line (25) extending to said holder body and a fuel return line (29) extending from said holder body, said fuel supply line and said fuel return line extending on a downward incline relative to a longitudinal axis of said holder body (13) with said fuel return line on a line higher than said fuel supply line, said fuel supply line and said fuel return line having a inlet end and an outlet end, said inlet end of said fuel supply line being on a plane perpendicular with the axis of said holder body in which said inlet end of said fuel supply line is higher than said inlet from said holder body to said fuel return line, said outlet end of said fuel return line being on a plane perpendicular with the axis of said holder body which is at a height above said holder body and higher than said inlet to said fuel supply line, and a fuel inlet line which supplies fuel to said inlet end of said fuel supply line from a fuel supply on an upward incline relative to said input end of said fuel supply line.

6. A fuel injection system as defined in claim 5 which includes a pressure regulating valve, said pressure regulating valve includes a valve seat and a valve closing element disposed at the highest point in said fuel return line, and a return flow line (33) connected to said pressure regulating valve at a point higher than said valve closing element.

7. A fuel injection system as set forth in claim 5 which includes a fuel injection valve within said holder body, a cap (16) which fixes said fuel injection valve coaxially within said holder body, said fuel injection valve having upper and lower axially spaced circumferential grooves between the outer circumference of said fuel injection valve and said holder body, said lower groove communicating with the interior of said valve and with said outlet end of said fuel supply line, said upper groove communicating with said interior of said fuel injection valve and said inlet of said fuel return line.

8. A fuel injection system as set forth in claim 7 which includes a deaeration chamber (22) adjoining said inlet end of said fuel supply line and said fuel inlet line, and a deaeration nozzle (32) which extends upwardly from said deaeration chamber to said output end of said fuel return line.

9. A fuel injection system as set forth in claim 8 which includes a pressure regulator (31), said pressure regulator including a diaphragm which forms a spring loaded chamber and a regulating chamber (30) which connects with said outlet end of said fuel supply line, an outlet from said regulator which connects with a fuel return line, a valve secured to said diaphragm which controls fuel-air flow from said regulating chamber to said outlet, and said valve is positioned on a plane perpendicular to the axis of said holder body which is higher than said outlet end of said fuel return line (29).

10. A fuel injection system as set forth in claim 9 in which said deaeration nozzle (32) has a cross section such that approximately 2% of the fuel returning to said supply via said valve flows through said deaeration nozzle.

11. A fuel injection system as set forth in claim 8 in which said deaeration nozzle (32) has a cross section such that approximately 2% of the fuel returning to said supply via said valve flows through said deaeration nozzle.

* * * * *